United States Patent [19]

Sato et al.

[11] 4,084,568

[45] Apr. 18, 1978

[54] DECOMPRESSION-TYPE INTERNAL-COMBUSTION ENGINE AND METHOD OF IMPROVING THE CHARACTERISTICS OF SUCH ENGINE

[75] Inventors: Kazunobu Sato, Wako; Takanori Suzuki; Tadataka Kobayashi, both of Tokyo; Takeshi Miyazawa, Wako, all of Japan

[73] Assignee: Honda Giken Kogyo Kabushiki Kaisha, Tokyo, Japan

[21] Appl. No.: 646,398

[22] Filed: Jan. 2, 1976

[30] Foreign Application Priority Data

Jan. 7, 1975 Japan ..... 50-4285

[51] Int. Cl.[2] ..... F01L 13/08

[52] U.S. Cl. ..... 123/182; 123/90.6; 123/105

[58] Field of Search ..... 123/75 E, 90.6, 105, 123/109, 182

[56] References Cited

U.S. PATENT DOCUMENTS

| | | | |
|---|---|---|---|
| 2,344,993 | 3/1944 | Lysholm | 123/105 |
| 2,644,436 | 7/1953 | Berlyn | 123/90.6 |
| 3,403,667 | 10/1968 | Santi | 123/182 |
| 3,574,304 | 4/1971 | Santi | 123/90.6 |

FOREIGN PATENT DOCUMENTS

| | | | |
|---|---|---|---|
| 948,477 | 2/1964 | United Kingdom | 123/182 |

*Primary Examiner*—Charles J. Myhre
*Assistant Examiner*—David D. Reynolds
*Attorney, Agent, or Firm*—Haseltine, Lake & Waters

[57] ABSTRACT

Improved decompression-type, four-cycle internal-combustion engine which has the conventional compression chamber, reciprocable piston, and intake valve therein; comprising, in accordance with the invention, means for delaying the closing time of the valve, in the course of the compression stroke, with the piston moving upwards, for obtaining reduced compression pressure; and means for closing the valve to its at least nearly closed condition within the closing delay period. The inventive delaying and closing means is preferably embodied in a specifically shaped cam for controlling the operation of the intake valve, with respective depressed, slightly protruding as well as flat portions at preferred, predetermined crank angle positions.

4 Claims, 4 Drawing Figures

Compression pressure
Rotation speed
(R.P.M.)
Lift amount
Crank angle
0
500
1000
1500
2000
2500
3000
3500
4000
10
5
4
7
3
6
5
1
2
3
4
5
6
(mm)
300°
330°
0
30°
60°
90°
120°
150°
180°
210°
240°
270°
300°
330°
360°

DECOMPRESSION-TYPE INTERNAL-COMBUSTION ENGINE AND METHOD OF IMPROVING THE CHARACTERISTICS OF SUCH ENGINE

FIELD OF THE INVENTION

This invention relates to a decompression-type, four-cycle internal-combustion engine in which the compression pressure within the combustion chamber is reduced at the time of starting the engine so that the starting becomes easy and smooth.

BACKGROUND

With this type of engine it has been usual that the intake valve is kept more or less in its open condition, in the course of the compression stroke, with the piston moving upwards, in succession to the suction stroke wherein the piston moves downwards, until the piston reaches near its upper dead point, at a crank angle of approximately 360°.

In other words, the full closing time of the intake valve can be slightly delayed towards the upper dead point, in comparison with that of an ordinary or compression-type engine.

Thus the decompression-type, four-cycle engine operates so that, at the time of starting, with the piston moving upwards in the compression stroke, the compressed mixture above the piston is vented therethrough, so that no excessive compression pressure is produced within the combustion chamber. Consequently, the starting operation by means of the kick pedal or the like can be facilitated as to the encountered load, and starting becomes easy and smooth.

With this arrangement, however, when the engine is then transferred to its own operation, large compression pressures cannot be obtained, in almost the same manner as with starting, so that an inferior output characteristic cannot be avoided.

When the intake valve is delayed in its closing time, the resultant compression pressure is much lower than that obtained with an ordinary engine, and thus the output characteristic is lower.

SUMMARY OF THE INVENTION

This invention has for its object to provide an engine free from the foregoing defects and a method of improving the characteristics of such engines.

According to important features of the invention, an improved decompression-type, four-cycle internal-combustion engine is provided, the engine having a compression chamber, a reciprocable piston, and an intake valve therefor; the improvement consisting in the provision of means for delaying the closing time of the valve, in the course of the compression stroke, with the piston moving upwards, for obtaining reduced compression pressure; and means for closing the valve to its at least nearly closed condition within the closing delay period.

In a preferred, exemplary embodiment, the delaying and closing means are incorporated in a specially shaped cam that controls the operation of the intake valve. Preferably, this cam has protruding, depressed, slightly protruding, and flat portions, so as to perform the opening, partial closing, and complete closing of the intake valve.

Furthermore, the invention is also embodied in a novel method of improving the compression pressure in the output characteristics of such decompression-type, four-cycle internal-combustion engines, including the corresponding steps of delaying the closing time of the intake valve in the course of the compression stroke, and closing the valve to its at least nearly closed condition within the closing delay period.

Other objects and many of the attendant advantages of the inventive engine and method will be readily appreciated as the same becomes better understood by reference to the following detailed description, when considered with the accompanying drawings.

DETAILED DESCRIPTION

The engine according to the present invention is not different from a conventional or ordinary decompression-type engine, except that the usual intake valve is delayed in its closing time towards the upper dead point.

Figure 1:
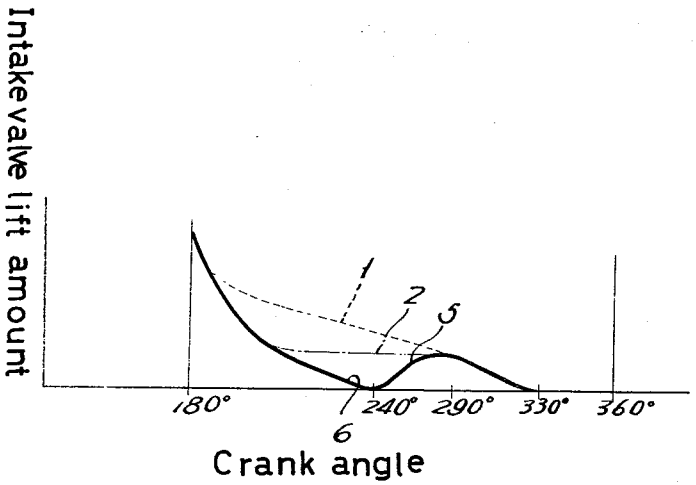
FIG. 1 is a graph showing the operation characteristics of intake valves in decompression-type, four-cycle internal-combustion engines.

FIG. 1 plots the lifting amount of the intake valve as a function of the crank angle. The interrupted curve 1 relates to conventional operating characteristics, and so does the slightly different, dot-dash curve 2.

Figures 2, 3:
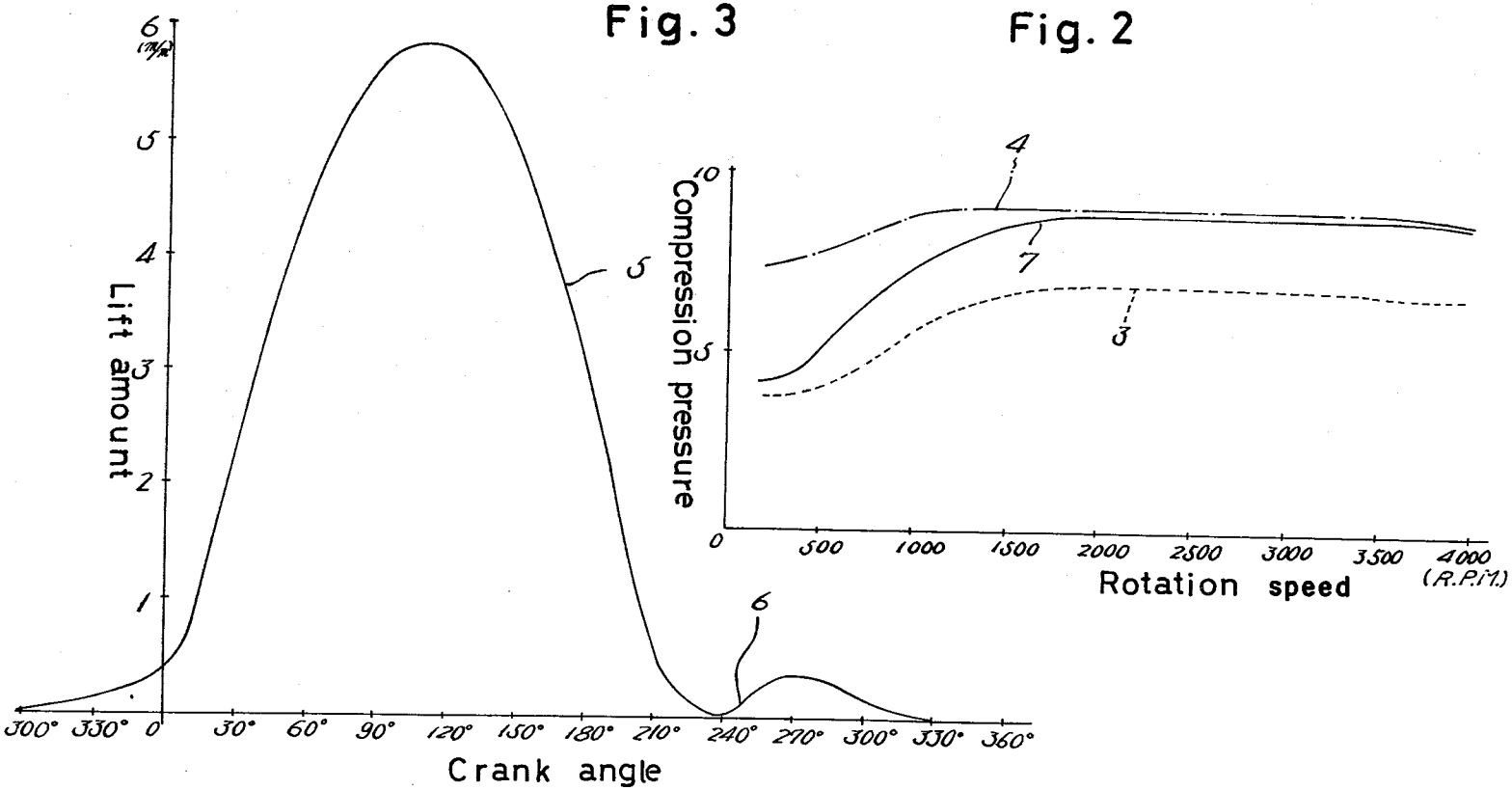
FIG. 2 is a similar graph of the compression pressures.
FIG. 3 is a graph, similar to a portion of curve 5 in FIG. 1, of one example of the operation characteristics of an intake valve according to this invention.

In FIG. 2, resulting compression pressures are plotted against the number of revolutions of the engine, the curve 3 (drawn with a line similar to that of curve 1, again relating to ordinary engines), being similar to the somewhat higher and different curve 4).

The lifting movement of the intake valve, in accordance with the invention, is shown in FIG. 1 with the solid-line curve 5 that has a nearly closed point 6, to be described later. FIg. 3 constitutes a somewhat enlarged and more complete curve, with the identifying numerals 5, 6 as in FIG. 1, so as clearly to bring out the amount of intake-valve lifting (or closing) as a function of the crank angle.

In FIG. 2, the inventive compression-pressure curve is shown (again with a solid line) at 7, corresponding to the solid-line curves of FIGS. 1 and 3.

According to the invention, as shown by the curve 5 in FIG. 1, at a proper time within the earlier-explained delay period for closing the intake valve, for instance, at a point near a crank angle of 240°, the intake valve is closed to its fully or nearly fully closed condition, as shown with the point 6.

As mentioned earlier, FIG. 3 shows this in more detail. The point of closing of the intake valve is substantially delayed in relation to that in ordinary engines, for instance, as far as a point near a crank angle of 330°, but the valve is nearly fully closed about midway, for instance, at a point near a crank angle of 240°.

When the maximum lifting amount of the intake valve is set to be, for instance, 5.845 millimeters, the lifting amount at the angle of 240° is set to be, for instance, 0.1555 mm in the nearly fully closed condition, and then the valve is again opened slightly at a point near an angle of about 270° so as to be, for instance, 0.375 mm in its lifting amount. Thus, in relation to the maximum lift of the intake valve at 270° the intake valve is re-opened by 0.375/5.845 or about 6%.

By the inventive control of the intake valve, at the time of the engine starting, the compression pressure within the combustion chamber is allowed to leak out therethrough, to be reduced so as to avoid putting a large load on the starting operation, and accordingly starting becomes light and easy.

When, however, the engine is thereafter transferred to its own driving operation, the temporary closing of the intake valve largely takes effect, and there can be obtained a substantial compression pressure within the combustion chamber.

It has been established by the inventor's experiments that a compression pressure results as shown by the earlier explained curve 7 of FIG. 2. Especially at high-speed operation, the pressure comes close to or approaches the curve 4 of the same figure, obtained in the case of ordinary engines.

Figure 4:
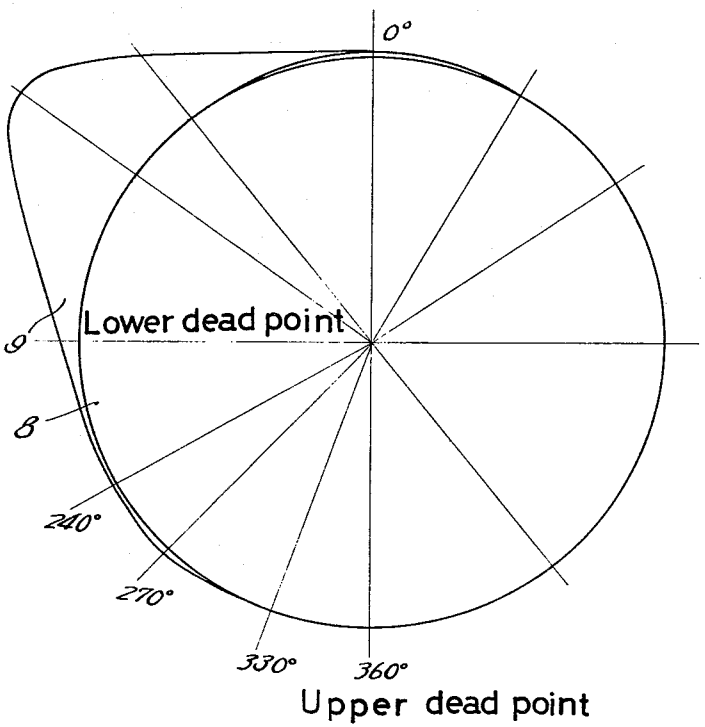
FIG. 4 is a somewhat schematic front view of an exemplary valve cam that can be used in the inventive engine.

Now that the principles of the novel, improved engine and of the method of improving the characteristics of ordinary engines have been explained, one can proceed to the schematic illustration of an exemplary, somewhat schematically shown valve cam in FIG. 4 that can be used for the operation of such intake valves. The cam is shown with a body portion 8 and a projection 9, having a skirt of a comparatively low height, continuously extending from a lower dead point towards an upper dead point, and ending at a point near a crank angle of 330°, as shown by the left-hand, outer edge of the cam surface. This cam projection 9 is so formed at its skirt that the same is slightly depressed at a point near a crank angle of 240°, and is then increased in height at a point near a crank angle of 270°, at which point the movement of the piston is comparatively large.

It will be understood by those skilled in the art that the more the cam or its projection protrudes, the more the intake valve is opened. Consequently, the valve is fully opened, during the compression stroke, when the cam (rotating in a clockwise direction) acts with the projection 9. Subsequently, the valve is nearly closed at an angle of 240°, is then slightly opened at 270°, and eventually fully closed at an angle of about 330°. From then on there is of course no opening until the cam makes about a half revolution, whereupon a slight ascending slope of the projection 9 starts, in the upper-right hand section, at a crank angle of approximately 150°.

Thus, according to the invention, wherein the intake valve of the above-described type of engine is delayed in its closing time, it is once operated (closed) toward its closing side, midway of the delay period. As a result, the lowering of the compression pressure at the time of the normal engine operation can be prevented as far as possible, without hampering the easy and smooth operation of starting. Especially at high speeds, a high compression pressure is achieved, not much different from that obtained by ordinary engines. Accordingly excellent output characteristics can be obtained. Such an operation is achieved by forming the valve cam 8 of the intake valve with a predetermined shape as described. The inventive arrangement and method are both economical.

It will be understood by those skilled in the art that the described decompression-type, four-cycle internal-combustion engines have conventional compression chambers, reciprocable pistons, and at least one intake valve therefor, details which have been omitted from the illustration of FIG. 4 because they are conventional and well known. Several handbooks, patents and/or earlier publications can be consulted to see these conventional arrangements, the only different and inventive feature residing in the specially shaped valve-operating cam of FIG. 4, to achieve the novel results as illustrated in FIG. 3, as well as the solid-line curves of FIGS. 1 and 2 (numbered 5, 6 and 7, respectively).

It will be understood, of course, that the foregoing disclosure relates only to a preferred engine embodiment and method of improving such engines, and that it is intended to cover all changes and modifications of the examples described that do not constitute departures from the spirit and scope of the invention.

What we claim is:

1. A four-cycle internal-combustion engine having a compression chamber, a reciprocable piston, at least one intake valve therefor and a cam for controlling the opening and closing of said intake valve, said cam being shaped to open said intake valve to a maximum degree of lift during the intake stroke and then gradually close said valve to momentarily effect substantial closure of the intake valve in the compression stroke at a crank angle of 240° and then to partially re-open said valve from said crank angle of 240° in gradually increasing amount up to 270° and thereafter to gradually close said valve and effect full closure at 330° whereby compression pressure at engine starting is reduced and at maximum operating speed is substantially unaffected.

2. An engine as claimed in claim 1 wherein said intake valve is lifted at 270° to be re-opened by about 6% of the maximum lift.

3. A method of controlling engine compression in a four-cycle internal combustion engine having a cylinder and an intake valve, said method comprising opening the intake valve to a maximum degree of lift during the intake stroke, gradually closing the intake valve to effect substantially complete and momentary closure during the compression stroke at a crank angle of 240°, then partially re-opening said intake valve in gradually increasing amount from 240° up to at an angle of 270° and thereafter gradually closing said valve to effect full closure at an angle of 330° whereby compression pressure at engine starting is reduced and at maximum operating speed is substantially unaffected.

4. A method as claimed in claim 3 wherein said intake valve is lifted at 270° to be re-opened by about 6% of the maximum lift.

* * * * *